US008497751B2

(12) United States Patent
Ziaei et al.

(10) Patent No.: US 8,497,751 B2
(45) Date of Patent: Jul. 30, 2013

(54) CAPACITIVE MICRO-SWITCH COMPRISING A CHARGE DRAIN BASED ON ORIENTED NANOTUBES ON THE BOTTOM ELECTRODE AND METHOD OF FABRICATION

(75) Inventors: Afshin Ziaei, Vanves (FR); Matthieu Le Baillif, Orsay (FR)

(73) Assignee: Thales, Neuilly sur Seine (FR)

( * ) Notice: Subject to any disclaimer, the term of this patent is extended or adjusted under 35 U.S.C. 154(b) by 99 days.

(21) Appl. No.: 12/938,088

(22) Filed: Nov. 2, 2010

(65) Prior Publication Data

US 2011/0100793 A1 May 5, 2011

(30) Foreign Application Priority Data

Nov. 3, 2009 (FR) ..... 09 05260

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS 7,042,397 B2 5/2006 Charrier et al.
7,297,571 B2 11/2007 Ziaei et al.
7,816,662 B2 * 10/2010 Shim et al. ..... 257/9
2006/0012940 A1 1/2006 Song et al.
2006/0255395 A1 * 11/2006 Fujita et al. ..... 257/315
2009/0231133 A1 9/2009 Ziaei
2009/0236211 A1 9/2009 Ziaei
2009/0237173 A1 9/2009 Ziaei
2009/0286491 A1 11/2009 Ziaei et al.
2010/0231326 A1 9/2010 Ziaei et al.
2011/0147177 A1 * 6/2011 Sakai et al. ..... 200/181
2011/0260293 A1 * 10/2011 Narita ..... 257/595
2012/0043858 A1 * 2/2012 Mahapatra et al. ..... 310/339

OTHER PUBLICATIONS

Chloe Bordas et al., "Carbon Nanotube Based Dielectric for Enhanced RF MEMS Reliability", Microwave Symposium, Jun. 1, 2007, pp. 375-378, IEEE/MTT-S International, XP031111928.

Lingbo Zhu, et al., "Lotus Effect Surface for Prevention of Microelectromechanical System (MEMS) Striction", Electronic Components and Technology Conference, May 31, 2005, pp. 1798-1801, IEEE, Piscataway, NJ, XP010808933.

* cited by examiner

*Primary Examiner* — Bernard Rojas
(74) *Attorney, Agent, or Firm* — Baker Hostetler LLP

(57) ABSTRACT

The invention relates to an electrostatic actuation micro-switch of capacitor type composed of two plates, the first of which is a flexible membrane and the second of which comprises at least one control electrode, the two plates being separated by a thickness of vacuum or gas and at least one layer of at least one electrical insulating material situated on the control electrode characterized in that it furthermore comprises a charge drain consisting of oriented conducting nanotubes on the surface of the said electrode, the said drain being overlaid with the said layer of electrical insulating material. The subject of the invention is also a method for fabricating the micro-switch according to the invention.

9 Claims, 3 Drawing Sheets

CAPACITIVE MICRO-SWITCH COMPRISING A CHARGE DRAIN BASED ON ORIENTED NANOTUBES ON THE BOTTOM ELECTRODE AND METHOD OF FABRICATION

CROSS-REFERENCE TO RELATED APPLICATION

This application claims priority to foreign French patent application No. FR 0905260, filed on Nov. 3, 2009, the disclosure of which is incorporated by reference in its entirety.

FIELD OF THE INVENTION

The field of the invention is that of micro-system components also called MEMS (the acronym standing for Micro Electro Mechanical Systems) and more particularly of radiofrequency or microwave-frequency micro-switches integrating a membrane deformable under the action of an electrostatic field. The main areas of application are telecommunications systems and radars.

BACKGROUND

Micro-system components have been developed over the last few decades on the basis of the technologies implemented for the production of electronic circuits.

They generally comprise a metallic beam or a membrane of small thickness, kept suspended by supports above mutually insulated conducting surfaces. A control electrode placed under the conducting surfaces and optionally separated from the said conducting surfaces by an insulating layer completes the device.

The membrane/control electrode assembly is subjected to an electric voltage by means of the control electrode. In the absence of applied voltage, the membrane is suspended above the conducting surfaces and there is no electrical contact between the said surfaces.

In general, radiofrequency or microwave-frequency MEMS micro-switches are not used as simple breakers. Indeed, direct contact between the membrane and the conducting surfaces or the control electrode appreciably decreases the lifetime of the device. A dielectric layer is interposed between the surfaces and the membrane. The simple function is thus transformed into a variation in the capacitance of a capacitor whose plates consist on the one hand of the membrane and on the other hand of the control electrode opposite. The capacitance then varies from a value $C_{up}$ to a value $C_{down}$.

The main advantages of this type of device are essentially:

- production techniques which are derived from conventional technologies for fabricating electronic integrated circuits. They make it possible to simplify production and integration and consequently, to obtain low fabrication costs as compared with those of other technologies, while guaranteeing high reliability;
- very low electrical powers consumed, a few microwatts being required for activation;
- size. A micro-switch is thus produced within an area of the order of a tenth of a square millimeter, making it possible to achieve high integration capacity;
- microwave-frequency performance. This type of micro-switch exhibits very small insertion losses, of the order of a tenth of a deciBel, much lower than those of devices affording the same functions.

In general, the deformable upper membrane is produced by deposition of one or more layers of materials, at least one of these layers being a conducting material. These materials are those customarily used in micro-electronics.

A particularly beneficial application of these microsystems resides in their use as microwave-frequency switches. The manner of operation of this type of switch is notably illustrated in FIGS. 1, 2 and 3.

In the initial position, the membrane 11 is situated at a distance d with respect to an RF line 12, on which a nitride layer 13 is deposited as illustrated in FIG. 1. Assuming that the RF line is also used as electrode, the two ends of the membrane are earthed 14 as illustrated in FIG. 2.

If a potential difference V is applied between the electrode and the membrane, the two parts are brought closer together by attracting the membrane towards the lower electrode (the RF track).

At a value V of the voltage, the displacement of the membrane exceeds a third of the initial gap. Thus the membrane collapses onto the lower electrode as illustrated in FIG. 3. The switch is said to be in the down position and this voltage value is dubbed the activation voltage.

When the membrane is in the up position, illustrated in FIG. 1, the RF signal passes along the RF line without being disturbed.

When the membrane is in the down position the signal passes along the RF line and is short-circuited by the membrane, thereby creating a reflection of the EM wave (microwave-frequency signal) on the membrane, the signal does not cross the RF MEMS switch.

The actuation used for the RF MEMS switch of FIG. 3 is an electrostatic actuation performed by applying a potential between the line (bottom electrode) and the membrane (top electrode). Other actuations are conceivable such as thermal, piezoelectric, magnetostatic or hybrid actuations (using two or more of the aforementioned four actuations).

The type of contact between the membrane and the line is of capacitive type on the RF MEMS switch of FIG. 3, that is to say a dielectric layer has been deposited on the bottom electrode. The line, the dielectric layer, the air gap and the membrane form a variable capacitance making it possible to allow through or to block the microwave-frequency signal. The second possible type of contact is ohmic contact (metal-metal) between the membrane and the line.

The central line is overlaid with a dielectric at the level of the membrane to prevent there being any ohmic contact and therefore a flow of charge when the membrane is in the down state. This gives the advantage of zero, or almost zero, consumption of power to keep the membrane in the down state by making use of the central line as actuation electrode.

This use is nonetheless not without consequence on the useful lifetime of the dielectric which gradually becomes electrically charged through use and actuation.

Indeed, when the membrane attains the down state, a conventional capacitive charge effect occurs in the dielectric between the line and the membrane, causing charge trapping in the dielectric (positive if the electrons are torn from the dielectric, negative if the electrons are imprisoned in the dielectric).

The performance of the switch is impaired as the dielectric becomes charged. The final and irreversible effect of this is to lead to a membrane remaining stuck by electrostatic force to the dielectric, definitively locking the RF MEMS Switch in the down state, thereby signifying the "death" of this RF MEMS switch.

SUMMARY OF THE INVENTION

To solve this problem the present invention proposes a novel type of micro-switch comprising an electric-charge drain inserted at the level of the dielectric layer overlying the RF line.

More precisely the subject of the present invention is an electrostatic actuation micro-switch of capacitor type composed of two plates, the first of which is a flexible membrane and the second of which comprises at least one control electrode, the two plates being separated by a thickness of vacuum or gas and at least one layer of at least one electrical insulating material situated on the control electrode characterized in that it furthermore comprises a charge drain consisting of oriented conducting nanotubes on the surface of the said electrode, the said drain being overlaid with the said layer of electrical insulating material.

Advantageously, the orientation of the nanotubes is perpendicular to the surface of the said electrode.

According to one variant of the invention, the nanotubes are carbon nanotubes.

According to one variant of the invention, the electrical insulating material is a dielectric.

According to one variant of the invention, the dielectric material is of $Si_3N_4$ or $ZrO_2$ or PZT type.

According to one variant of the invention, the ratio of the height of the nanotubes to the thickness of the layer of electrical insulating material is about 0.5.

According to one variant of the invention, the nanotubes are separated from one another by a distance greater than their height, so as to avoid electrical breakdown phenomena.

According to one variant of the invention, the nanotubes are distributed with a spacing of the order of 1 micron, the height of the said nanotubes being of the order of 0.1 micron, the thickness of the layer of electrical insulating material being of the order of 2 microns.

The subject of the invention is also a method for fabricating a micro-switch according to the invention, characterized in that it comprises

- the growth of oriented nanotubes on the surface of the electrode;
- the deposition of a layer of electrical insulating material on the surface of the electrode overlaid with the drain constituted by the nanotubes.

According to one variant of the invention, the growth of oriented nanotubes on the surface of the electrode comprises the growth of oriented nanotubes on the surface of the electrode by catalytic growth or decomposition of hydrocarbons on the basis of catalytic particles of the "CVD" ("Chemical Vapour Deposition") procedure type or of the "PECVD" ("Plasma Enhanced Chemical Vapour Deposition") type.

BRIEF DESCRIPTION OF THE DRAWINGS

The invention will be better understood and other advantages will become apparent on reading my description which follows, given without limitation, and by virtue of the appended figures among which.

DETAILED DESCRIPTION

Figure 1:
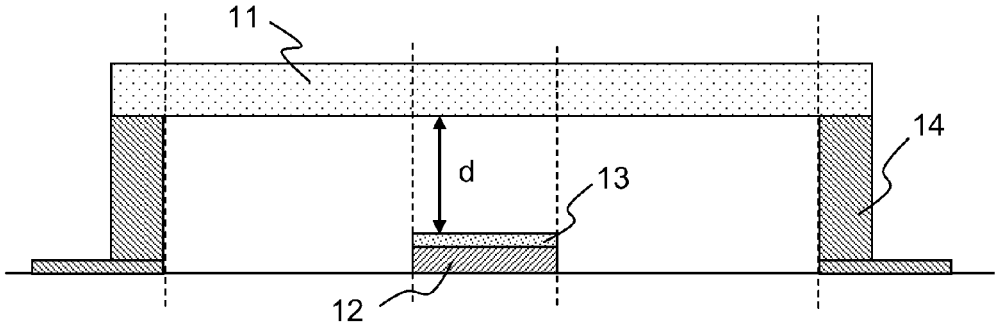
FIGS. 1, 2 and 3 illustrate the operation and the structure of an exemplary MEMS of RF micro-switch type according to the known art.
Figure 2:
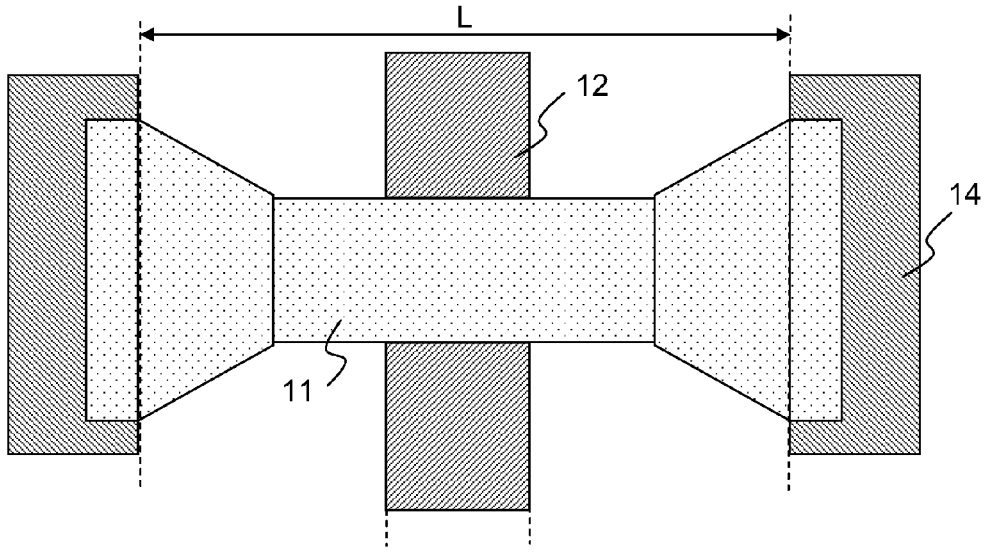
Figure 3:
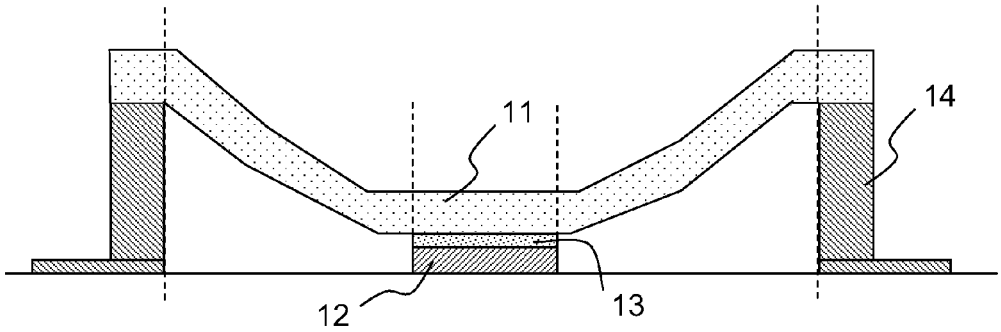
Figure 4:
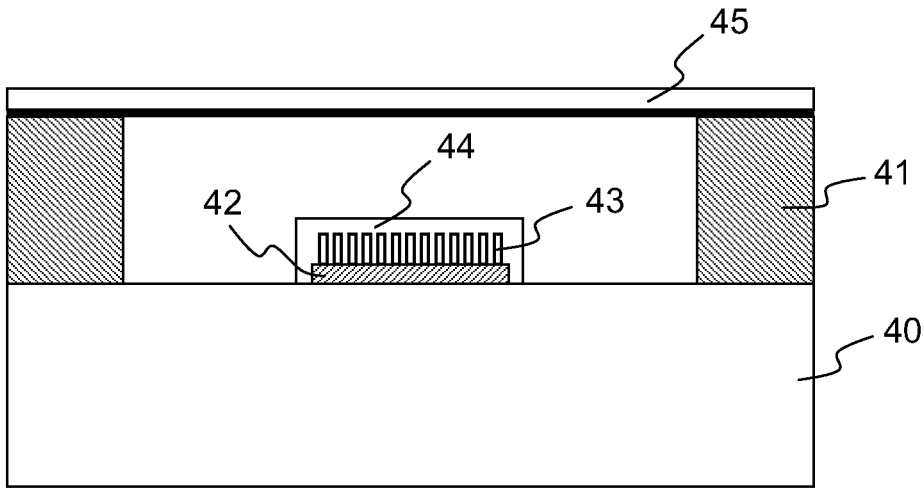
FIG. 4 illustrates a detailed sectional view of the capacitive RF MEMS switch of shunt type according to the invention.

An exemplary electrostatic actuation micro-switch of capacitor type according to the invention is illustrated in FIG. 4.

It comprises, made on the surface of a substrate 40, an RF signal line 42, on the surface of which is made the drain based on oriented carbon nanotubes 43 and overlaid with a layer of dielectric material 44. An upper metallic membrane 45 rests on the surface of pillars 41.

Typically, the membrane may be composed of one or two metallic layers that may for example be a layer of gold (Au) or a bi-layer structure of aluminium (Al) and of titanium and tungsten alloy (TiW) suspended between the two earth lines.

Typically, the dielectric layer may be a layer of dielectric material for example of ferromagnetic material that may typically be PZT: $Pb(Zr_xTi_{1-x})O_3$.

Whereas according to the prior art, the signal line is directly overlaid with the layer of dielectric material, the latter is subject to electrical discharges when the membrane attains its down state on account of the large voltage required for actuation and of the very small distance which results at the end when the membrane touches the dielectric. This gives rise to a gradual charging of the dielectric which becomes critical when the accumulated charge is sufficient to definitively maintain the membrane in the down state.

Thus, the invention proposes a solution consisting in producing capacitive RF MEMS switches whose dielectric layer consists of two elements: a forest of vertical, oriented carbon nanotubes, on which is deposited the dielectric layer normally used for the production of capacitive MEMS switches.

This allows a consequent reduction in the charging of the dielectric by creating conduction paths removing the surplus or else filling in the deficiencies in electrons giving rise directly to an increase in the lifetime of the capacitive RF MEMS switch, in a significant manner.

Moreover, the mesh of nanotubes is transparent to the operation of the capacitive RF MEMS switch and therefore does not constitute a disturbance in respect of its performance.

More precisely, the dielectric layer thus separated into two by an intermediate deposition of nano-structured compounds makes it possible to obtain a conducting middle layer allowing the supply or else the removal of charge carriers inside the dielectric so as to prevent the latter from becoming charged during the operation of the RF MEMS switch.

The effect of this is to increase the lifetime in terms of number of cycles of these RF MEMS switches.

It is known in detail that the charges of the upper part of the dielectric are imprisoned rapidly but released very slowly in contradistinction to that of the lower part of the dielectric in contact with a metallic layer.

Figure 5:
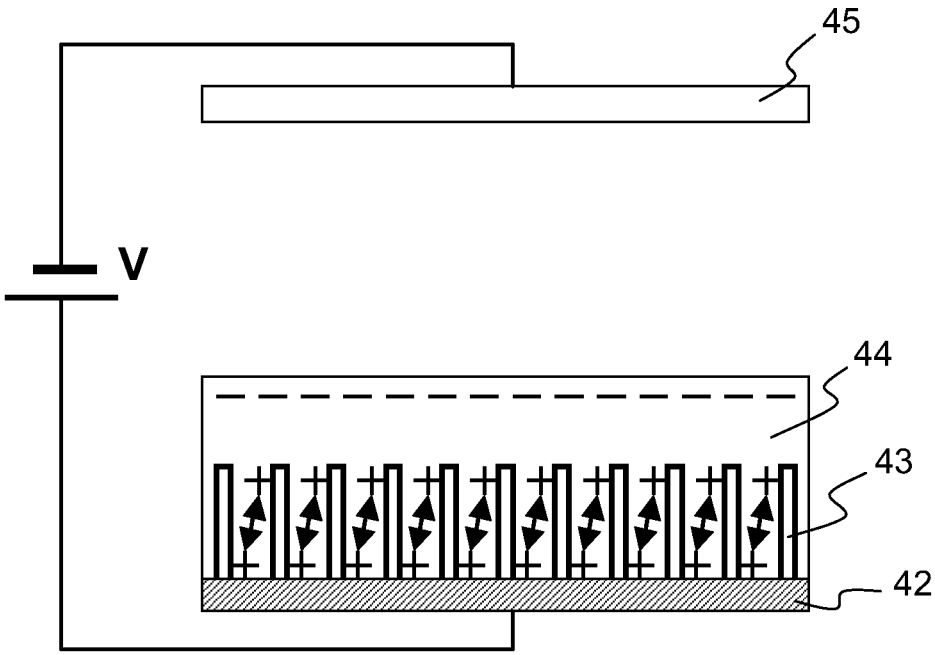
FIG. 5 illustrates a detailed view of the dielectric under the membrane of the RF MEMS switch comprising a drain of carbon nanotubes.

FIG. 5 illustrates in greater detail the assembly consisting of the drain of nanotubes and of dielectric and shows diagrammatically through arrows the mobility of the charges along the nanotubes.

The benefit of integrating the nanotubes into the dielectric and of being able to "drain" these charges from the upper part of the dielectric to the lower part in contact with a metallic surface. This makes it possible to release the charges thus imprisoned more easily and therefore to increase the lifetime of the switches.

The conductivity induced by the presence of these nanotubes remains negligible and does not disturb the operation of the RF MEMS switches.

Figure 6:
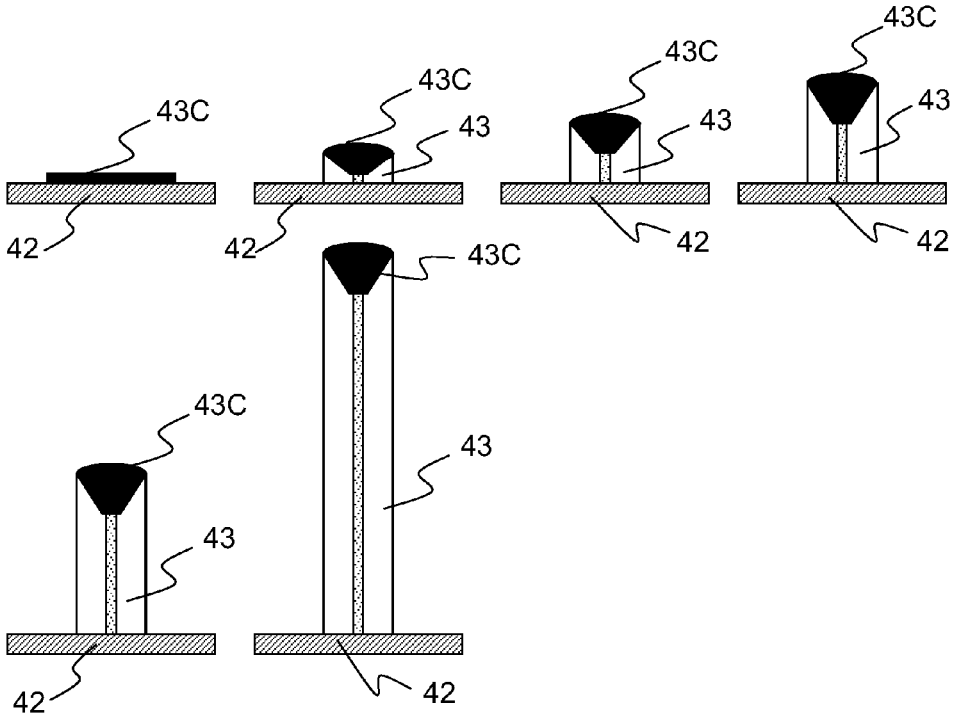
FIG. 6 illustrates a drain making step based on the growth of nanotubes in a method for fabricating a micro-switch according to the invention.

FIG. 6 illustrates in greater detail the operation of growing the nanotubes on the surface of the RF line consisting of a metallic line. This may advantageously entail a conventional operation of growth under an electric field on the basis of catalysis elements 43*c* distributed with respect to one another on the surface of the lower electrode 42, and placed under a plasma of hydrocarbons generate the growth of oriented nanotubes 43.

The invention claimed is:

1. An electrostatic actuation micro-switch of capacitor comprising:

a first plate that is a flexible membrane;

a second plate that comprises at least one control electrode, wherein the first and second plates are separated by a thickness of vacuum or gas and at least one layer of at least one electrical insulating material situated on the at least one control electrode; and a charge drain that comprises oriented conducting nanotubes on a surface of the said at least one control electrode, wherein the charge drain is shrouded by the said at least one layer of at least one electrical insulating material.

2. The electrostatic actuation micro-switch according to claim 1, wherein the nanotubes are carbon nanotubes.

3. The electrostatic actuation micro-switch according to claim 1, wherein the at least one electrical insulating material is a dielectric material.

4. The electrostatic actuation micro-switch according to claim 3, wherein the dielectric material is of $Si_3N_4$ or $ZrO_2$ or PZT type.

5. The electrostatic actuation micro-switch according to claim 1, wherein a ratio of a height of the nanotubes to a thickness of the at least one layer of at least one electrical insulating material is about 0.5.

6. The electrostatic actuation micro-switch according to claim 1, wherein the nanotubes are separated from one another by a distance greater than their height, so as to avoid electrical breakdown phenomena.

7. The electrostatic actuation micro-switch according to claim 6, wherein the nanotubes are distributed with a spacing of an order of 1 micron, the height of the said nanotubes being of an order of 0.1 micron, a thickness of the at least one layer of at least one electrical insulating material being of an order of 2 microns.

8. A method for fabricating a micro-switch according to claim 1, comprising:

growing the oriented conducting nanotubes on the surface of the at least one control electrode; and depositing the at least one layer of at least one electrical insulating material on the surface of the at least one control electrode overlaid with the charge drain constituted by the nanotubes.

9. A method for fabricating a micro-switch according to claim 8, wherein the growth of the oriented conducting nanotubes on the surface of the at least one control electrode comprises the growth by a catalytic decomposition of hydrocarbons on a basis of catalytic particles.

* * * * *